US006928993B2

(12) United States Patent
Yu

(10) Patent No.: US 6,928,993 B2
(45) Date of Patent: Aug. 16, 2005

(54) ENGINE THROTTLE BODY

(75) Inventor: Chul-Ho Yu, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/750,670

(22) Filed: Dec. 31, 2003

(65) Prior Publication Data

US 2005/0072408 A1 Apr. 7, 2005

(30) Foreign Application Priority Data

Oct. 2, 2003 (KR) ..... 10-2003-0068679

(51) Int. Cl.[7] ..... F02M 25/07

(52) U.S. Cl. ..... 123/568.17

(58) Field of Search ..... 123/568.11, 568.17, 123/568.18, 568.19, 337

(56) References Cited

U.S. PATENT DOCUMENTS

| | | | | |
|---|---|---|---|---|
| 5,666,930 | A * | 9/1997 | Elder | 123/568.17 |
| 5,746,190 | A * | 5/1998 | Honda | 123/568.18 |
| 5,884,612 | A * | 3/1999 | Takeyama et al. | 123/568.17 |
| 6,609,374 | B2 * | 8/2003 | Feucht et al. | 123/568.18 |

FOREIGN PATENT DOCUMENTS

| | | |
|---|---|---|
| JP | 10169474 | 6/1998 |

* cited by examiner

*Primary Examiner*—Willis R. Wolfe, Jr.
(74) *Attorney, Agent, or Firm*—Morgan Lewis & Bockius LLP

(57) ABSTRACT

The engine throttle body for inducing a smooth mixture of air and EGR gas regardless of the openness of a valve flap makes it possible for an engine to operate under a super thin air condition through the even mixture between air and EGR gas during a low engine load, thereby improving fuel consumption and reducing the exhaust of nitrogen oxide.

3 Claims, 2 Drawing Sheets

ENGINE THROTTLE BODY

CROSS-REFERENCE TO RELATED APPLICATIONS

This application claims priority of Korean Application No. 10-2003-0068679, filed on Oct. 2, 2003, the disclosure of which is incorporated fully herein by reference.

FIELD OF THE INVENTION

The present invention relates to an engine throttle body and, more particularly, to an engine throttle body adapted to induce a smooth mixture of exhaust gas reintroduced into an exhaust system of an engine via an Exhaust Gas Recirculation (EGR) duct and air introduced into the exhaust system of the engine via a throttle body.

BACKGROUND OF THE INVENTION

Generally, Gasoline Direct Injection (GDI) engines, unlike Multi Point Injection (MPI) engines, introduce lots of EGR gas into a combustion chamber in order to reduce the burden of a catalyst for removal of nitrogen oxide. This is so that the amount of nitrogen oxide contained in burnt gas can be reduced.

However, there is a problem in the GDI engines thus described in that an engine runs under a super thin air state such that EGR gas introduced into a combustion chamber is less likely to combust properly. Particularly, a mixture level between fresh air and the EGR gas greatly influences the combustion stability for GDI engines.

SUMMARY OF THE INVENTION

The present invention provides an engine throttle body configured to smoothly mix air and EGR gas, thereby inducing a smooth and even mixture between air and exhaust gas regardless of how open a valve flap is.

In accordance with a preferred embodiment of the present invention, the engine throttle body includes a valve flap disposed in a main passage through which air to be supplied to a combustion chamber passes, and an EGR gas inflow passage. Gas mixing means induces EGR gas from the EGR gas inflow passage to the main passage in a substantially perpendicular direction to the rotational axis of the valve flap.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENT

The preferred embodiment of the present invention will now be described in detail with reference to the annexed drawings.

Figure 1:
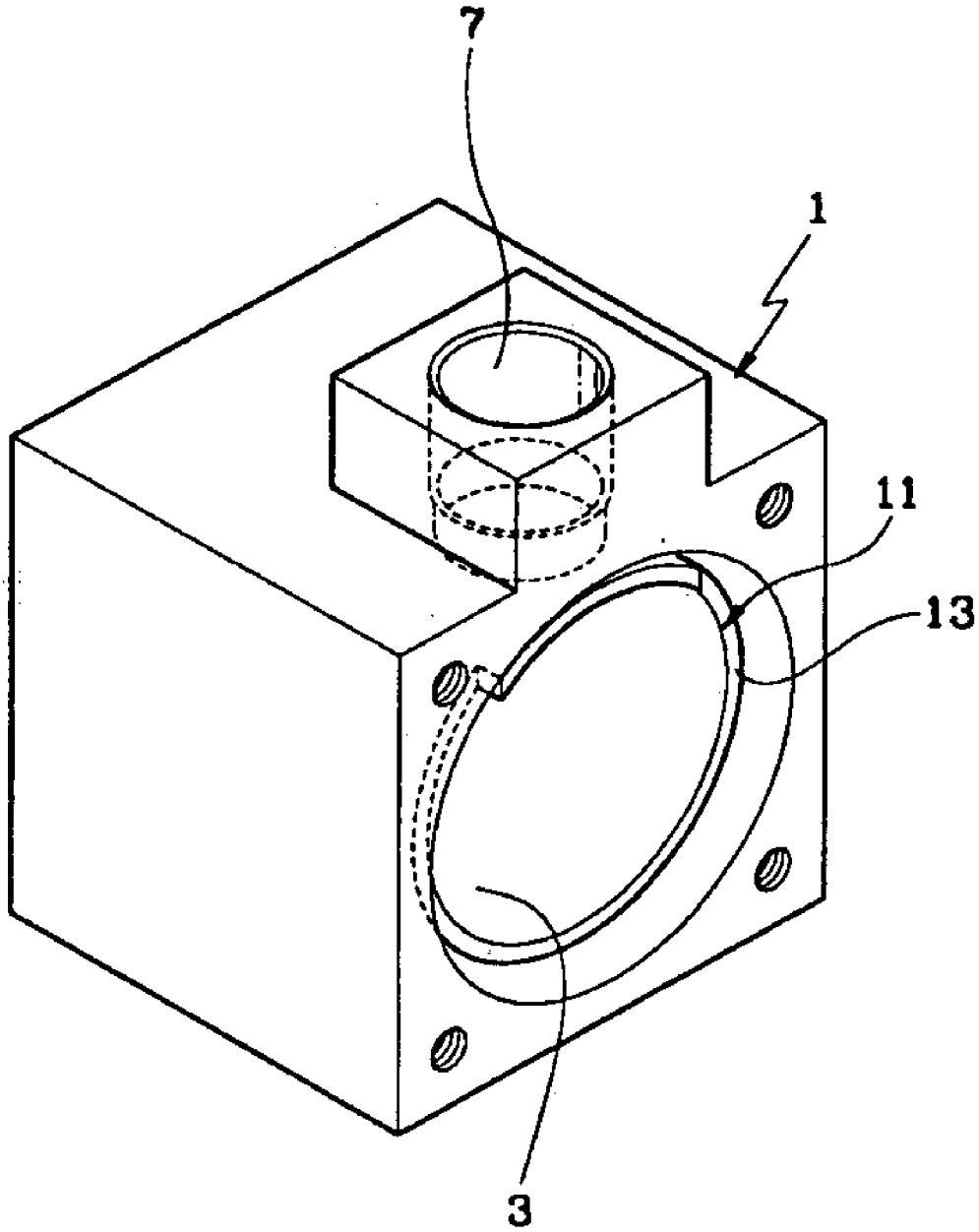
FIG. 1 is a perspective view for illustrating a throttle body according to an embodiment of the present invention.
Figure 2:
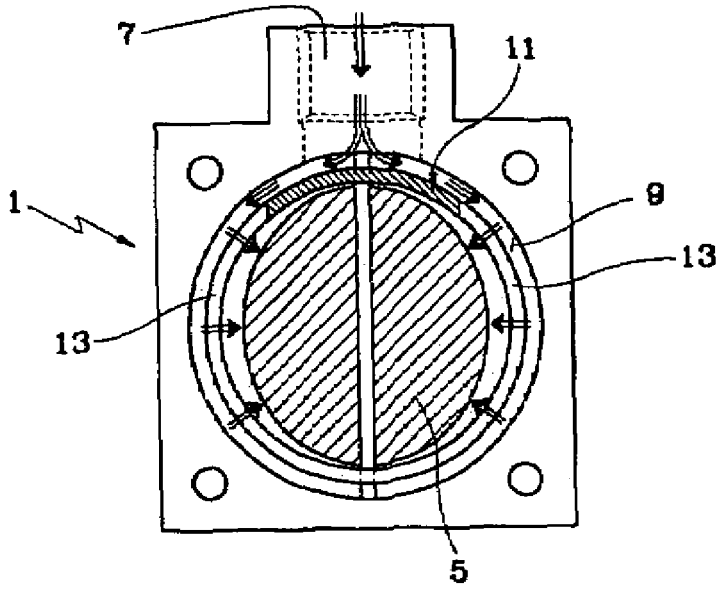
FIG. 2 is a front view for illustrating an outlet portion of a throttle body of FIG. 1.
Figure 3:
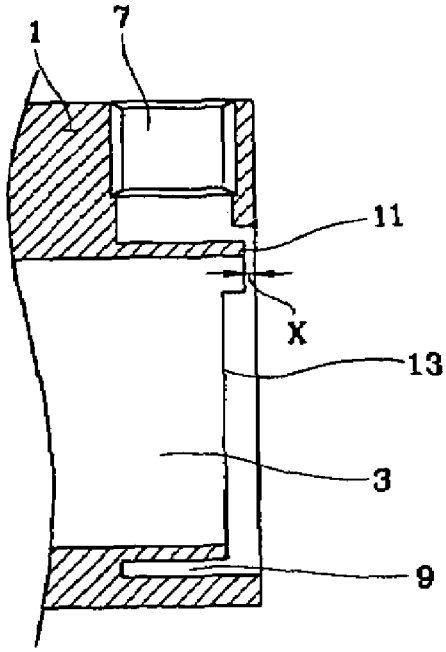
FIG. 3 is a partial cross-sectional view for illustrating an outlet portion of the throttle body of FIG. 1.

As shown in FIGS. 1, 2 and 3, a throttle body is formed with a main passage 3 for supplying air into a combustion chamber, and is mounted with a valve flap 5 for adjusting the amount of suction air to be supplied into the combustion chamber. The throttle body 1 is integrally formed with an EGR gas inflow passage 7. In the present embodiment of the invention, the EGR gas inflow passage 7 is formed parallel to the rotational axis of the valve flap 5 and perpendicularly to the main passage 3.

A gas mixing means is provided at the downstream position in relation to the valve flap 5 in the main passage 3. The gas mixing means induces the EGR gas coming from the EGR gas inflow passage 7 toward the main passage 3, thereby mixing the EGR gas with the air in a substantially perpendicular direction to the rotational axis of the valve flap 5.

The gas mixing means includes a cylindrical barrier wall 11 that forms part of the main passage 3. The cylindrical barrier wall 11 isolates the main passage 3 and a mixture reserve space 9. A mixture reserve space 9 is formed to be connected to the EGR gas inflow passage 7 and to encompass the main passage 3. The gas mixing means also includes a cut-out part 13 formed at the cylindrical barrier wall 11 for allowing the main passage 3 to communicate with the mixture reserve space 9.

In other words, the gas mixing means induces the EGR gas supplied from the EGR gas inflow passage 7 to the main passage 3 to allow the EGR gas to be mixed with the air sucked into the main passage 3 at the outer circumference of the main passage in the perpendicular direction in relation to the rotational axis of the valve flap 5.

As illustrated in FIG. 3, the cylindrical barrier wall 11 is inwardly recessed from an outer surface of the combustion chamber side of the throttle body 1, such that a space of X is formed between the outer surface of the throttle body 1 and a distal end of the cylindrical barrier wall 11. In the present embodiment, the cut-out part 13 formed at the cylindrical barrier wall 11 is formed around the entire circumference of the cylindrical barrier wall 11 except for a portion adjacent to the EGR gas inflow passage 7.

In other words, as shown in FIG. 2, the cut-out part 13 is extended to a portion of the main passage 3 in a perpendicular direction to the rotational axis of the valve flap 5, and is further extended to a portion of the main passage 3 underneath the rotational axis of the valve flap 5.

The operation of the engine throttle body thus constructed according to the embodiment of the present invention will now be described.

The space formed between the main passage 3 and the valve flap 5, while the valve flap 5 is rotated, is formed substantially perpendicularly to the rotational axis of the valve flap 5, such that air flow toward the combustion chamber via the valve flap 5 flows through the space, causing the air flow to be the fastest at this portion. The cut-out portion 11 formed at the barrier wall 11 induces the EGR gas introduced into the EGR gas inflow passage 7 toward the space via the mixture reserve space 9, such that, as mentioned in the above, the EGR gas passes through the space to be added to the main portion of air flow introduced into the combustion chamber for mixture therebetween.

Particularly, as the opening of the valve flap 5 is so small, the effect of the EGR gas on the combustion in the engine becomes relatively large during a low load of a small amount of air supplied to the combustion chamber. Accordingly, the mixture level between the air and the EGR is satisfactory. However, the air passing through the space between the valve flap 5 and the main passage 3 flows near the portion of the main passage 3 substantially perpendicular to the rotational axis of the valve flap 5 even during the low load of the engine thus described. Accordingly, such that the EGR gas supplied via the cut-out portion 13 is directly supplied to the main flow of the air supplied to the combustion chamber to accomplish a smooth mixture therebetween.

As a result, the EGR gas is directly introduced into the main flow of the air sucked into the combustion chamber at all times regardless of how open the valve flap 5 is that is changing to the load condition of the engine, thereby achieves a smooth mixture between the EGR gas and the air sucked into the combustion chamber, and thereby achieving stable engine operation.

As apparent from the foregoing, there is an advantage in the engine throttle body thus described according to the embodiment of the present invention in that a smooth mixture of air and EGR gas can be obtained in the throttle body regardless of how open the valve flap is. Another advantage is that engine operation is possible under a super thin air condition through the even mixture between the air and the EGR gas during a low load of the engine, thereby improving fuel consumption and reducing the exhaust of nitrogen oxide.

What is claimed is:

1. An engine throttle body comprising:

a valve flap disposed in a main passage through which air passes to be supplied to a combustion chamber;

an Exhaust Gas Recirculation (EGR) gas inflow passage;

gas mixing means for inducing EGR gas at a downstream position in relation to the valve flap from said EGR gas inflow passage to said main passage in a substantially perpendicular direction to a rotational axis of said valve flap;

a cylindrical barrier wall that forms one portion of said main passage and at least partially isolates said main passage from a mixture reserve space encompassing said main passage and being connected to said EGR gas inflow passage; and a cut-out part formed at said cylindrical barrier wall for allowing said main passage, which is substantially perpendicular to the rotational axis of said valve flap, to communicate with said mixture reserve space.

2. The body as defined in claim 1, wherein said EGR gas inflow passage is formed substantially parallel to the rotational axis of said valve flap and substantially perpendicular to said main passage, and said cut-out part at said cylindrical barrier wall is formed around the entire circumference of said cylindrical barrier wall except for a portion adjacent to said EGR gas inflow passage.

3. The body as defined in claim 1, wherein said cylindrical barrier wall is caved in from a surface of the combustion chamber side at the throttle body.

* * * * *